US010238934B2

(12) United States Patent
Becktor

(10) Patent No.: US 10,238,934 B2
(45) Date of Patent: Mar. 26, 2019

(54) GOLF CLUB GRIP

(71) Applicant: Dunlop Sports Co., Ltd., Kobe-shi, Hyogo (JP)

(72) Inventor: Mika Becktor, Costa Mesa, CA (US)

(73) Assignee: Dunlop Sports Co., Ltd., Kobe-shi (JP)

( * ) Notice: Subject to any disclaimer, the term of this patent is extended or adjusted under 35 U.S.C. 154(b) by 0 days.

(21) Appl. No.: 15/640,437

(22) Filed: Jun. 30, 2017

(65) Prior Publication Data

US 2019/0001201 A1 Jan. 3, 2019

(51) Int. Cl.
*A63B 53/14* (2015.01)
*A63B 53/00* (2015.01)

(52) U.S. Cl.
CPC ..... *A63B 53/14* (2013.01); *A63B 53/007* (2013.01); *A63B 2209/00* (2013.01)

(58) Field of Classification Search
CPC ... A63B 53/14; A63B 53/007; A63B 2209/00; A63B 60/12; A63B 60/10; A63B 60/14
See application file for complete search history.

(56) References Cited

U.S. PATENT DOCUMENTS 4,365,807 A * 12/1982 Melby ..... A63B 60/22 473/295
5,460,372 A * 10/1995 Cook ..... A63B 60/16 473/204
6,626,768 B2 * 9/2003 Roelke ..... A63B 53/14 473/296
6,783,463 B2 8/2004 Zichmanis
6,902,492 B1 6/2005 Strand
6,988,958 B2 1/2006 Roelke
8,272,973 B2 9/2012 Lu
8,858,356 B2 10/2014 Chu et al.
8,932,146 B2 1/2015 Chu et al.
9,072,952 B2 * 7/2015 Chu ..... A63B 53/14
(Continued)

FOREIGN PATENT DOCUMENTS

DE 102011120059 A1 * 6/2013 ..... A63B 53/14
JP 08252347 A * 10/1996 ..... A63B 53/14

OTHER PUBLICATIONS

Wolfe, Dave, "The Club Report: Cleveland Huntington Beach Collection and TFI 2135 Mallets", MyGolfSpy, Aug. 15, 2016, pp. 1 to 22, available at: https://mygolfspy.com/the-club-report-cleveland-huntington-beach-collection-and-tfi-2135-mallets/.

*Primary Examiner* — Stephen Blau
(74) *Attorney, Agent, or Firm* — Barry IP Law, P.C.

(57) ABSTRACT

A grip for a putter-type golf club including a bottom end having a recess to receive a golf shaft, and a top end opposite the bottom end. The recess defines a longitudinal axis, and an exterior side surface extends about the circumference of the longitudinal axis. The exterior side surface defines a generally planar portion and a generally arcuate portion adjoining the planar portion. A grip cross-section no greater than 15 mm from the top end includes a planar portion cross-sectional width no less than 4 mm, a first cross-sectional length, L1, and a maximum cross-sectional width located at a depth D1 from the planar portion such that D1/L1 is no greater than 0.40. According to another aspect, a grip cross-section between 120 mm and 140 mm from the top end includes a cross-sectional maximum width, W3, and a cross-sectional length, L3, such that W3/L3 is no greater than 0.90.

19 Claims, 2 Drawing Sheets

(56) References Cited

U.S. PATENT DOCUMENTS

| | | | | |
|---|---|---|---|---|
| 9,233,284 | B2 * | 1/2016 | Nathan | A63B 53/14 |
| 9,421,439 | B2 * | 8/2016 | McLoughlin | A63B 53/14 |
| 9,700,772 | B2 * | 7/2017 | Goldfader | A63B 53/14 |
| 2003/0211900 | A1 * | 11/2003 | Novak | A63B 53/14 473/300 |
| 2007/0259732 | A1 * | 11/2007 | Billings | A63B 60/00 473/303 |
| 2008/0176670 | A1 * | 7/2008 | Gill | A63B 60/00 473/300 |
| 2013/0248089 | A1 * | 9/2013 | Su | B25G 1/10 156/192 |
| 2015/0196813 | A1 * | 7/2015 | Chu | A63B 53/14 473/303 |
| 2016/0096089 | A1 * | 4/2016 | Garsen | A63B 53/007 473/303 |
| 2018/0154231 | A1 * | 6/2018 | Garsen | A63B 60/10 |

* cited by examiner

GOLF CLUB GRIP

BACKGROUND

As the point of contact with a golfer, golf club grips can greatly affect the ergonomics and "feel" of a golf club. The ergonomics of the golf club can represent the amount of control, or the efficiency of such control the golfer has over the golf club during a swing. The "feel" of the golf club can represent how comfortably the grip fits in the golfer's hands and the combination of impact effects between the golf club and a golf ball that are capable of being sensed by the golfer through the grip. The effect of a grip on the ergonomics and feel of the golf club can be particularly apparent for putter-type golf clubs where a golfer typically needs to use a slower and more finely controlled swing as compared to other types of golf clubs.

Some putter-type golf club grips may include a flattened portion of the grip generally in line with the direction the golf ball is intended to roll after being hit. For some grip styles and hand dimensions, the flattened portion of the grip may allow the golfer's hands to provide additional control for rotational movement and resistance from rotational deviation during swing and/or impact with a golf ball. However, these conventional grips often do not provide an improved level of control or feel for a variety of grip styles, such as a tight grip versus a loose grip, or a compressed grip versus a spread grip. In addition, conventional grips for putter-type golf clubs generally fail to provide a high level of control or feel for a variety of different hand dimensions or hand sizes of different golfers. This can cause some golfers to have less control or not as good of a feel when using such grips.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1:
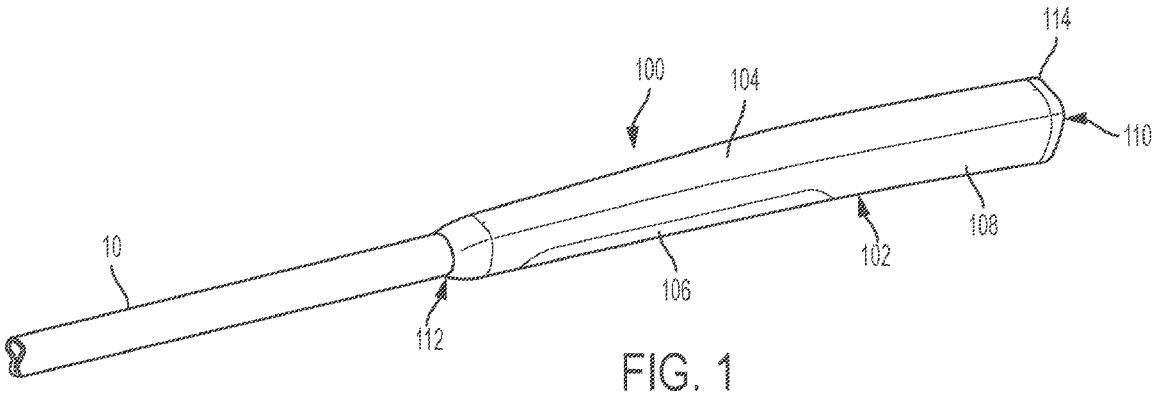
FIG. 1 is a partial perspective view of a putter-type golf club including a golf shaft and a grip according to an embodiment.

FIG. 1 is a partial perspective view of a putter-type golf club including golf shaft 10 and grip 100 according to an embodiment. As shown in FIG. 1, grip 100 includes bottom end 112 having a recess therein (i.e., recess 114 in FIG. 4) for receiving golf shaft 10 and defining a virtual longitudinal axis of grip 100 (i.e., longitudinal axis 136 in FIGS. 3 to 7). Grip 100 also includes top end 110 opposite bottom end 112, and exterior side surface 102 extending about a circumference of the longitudinal axis (i.e., circumference 137 in FIGS. 3 and 4). Exterior side surface 102 defines generally planar portion 104 and generally arcuate portion 108 adjoining planar portion 104. In the example of FIG. 1, grip 100 includes grooved portion 106 on a rear side of exterior side surface 102 to help channel moisture or debris, and/or provide for airflow to help cool a player's hands.

Grip 100 can include a material such as, for example, a synthetic rubber, natural rubber, and/or an elastomer. Grip 100 may alternatively or additionally include a material such as Acrylonitrile Butadiene Styrene (ABS) plastic, open-cell or closed-cell foam, or leather.

Figure 2:
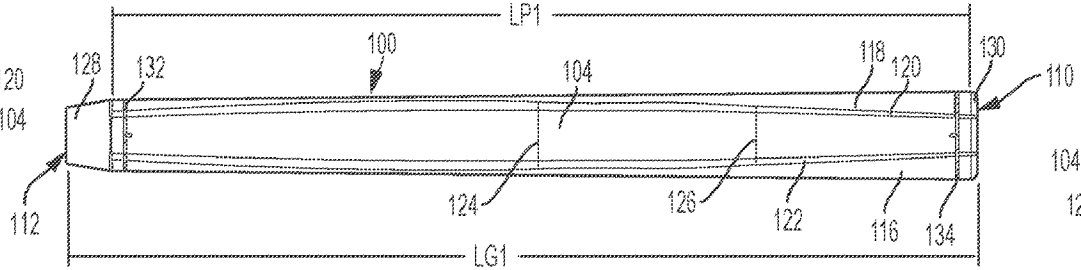
FIG. 2 is a front view of the grip of FIG. 1.

FIG. 2 is a front view of grip 100. As shown in FIG. 2, planar portion 104 includes planar breaks 124 and 126 where the angle of planar portion 104 changes slightly (e.g., within ten degrees) relative to an adjacent area of planar portion 104. In other implementations, planar portion 104 may gradually change its angle without defined planar breaks, such that planar breaks 124 and 126 are omitted. In yet other implementations, planar portion 104 may maintain the same angle and lie entirely within a single plane.

In the top view of FIG. 2, arcuate portion 108 includes top curved portions 116, 118, 120, and 122 that connect planar portion 104 to rear curved portion 107 of arcuate portion 108. In some implementations, a single top curved portion may connect planar portion 104 to rear curved portion 107 on each side of planar portion 104, or arcuate portion 108 may include a flat angled portion instead of a top curved portion that connects planar portion 104 to rear curved portion 107 on each side of planar portion 104.

Grip 100 also includes grooves 132 and 134 located near bottom end 112 and top end 110, respectively. Grooves 132 and 134 may provide an aesthetic quality to grip 100 and/or serve to provide a visual indication for helping a golfer locate their hands on grip 100.

As shown in FIG. 2, planar portion 104 extends along most of the length of grip 100. Specifically, the length of planar portion 104, LP1, extends from conical frustum portion 128 to top portion 130. In some implementations, LP1 may be no less than (i.e., greater than or equal to) 220 mm as measured in a direction of a longitudinal axis of the grip (i.e., longitudinal axis 136 in FIGS. 3 to 7). In other implementations, LP1 may be no less than 240 mm, preferably no less than 245 mm and no greater than (i.e., less than or equal to) 255 mm, and most preferably 250 mm or approximately 250 mm (e.g., 247 mm to 253 mm).

Grip 100 may also have an overall grip length, LG1, such that the ratio of the length of the planar portion 104 to the overall grip length (i.e., LP1/LG1) is no less than 0.90, more preferably no less than 0.95, and most preferably 0.98 or approximately 0.98 (e.g., 0.97 to 0.99), but less than 1.00. In some implementations, LG1 is no less than 250 mm, more preferably no less than 250 mm and no greater than 270 mm, and even more preferably 255 mm or approximately 255 mm (e.g., 252 mm to 258 mm).

By increasing the length of planar portion 104 along grip 100 as compared to conventional grips, it is ordinarily possible to better fit or match planar portion 104 to a wider variety of hand dimensions or hand sizes, and to a wider variety of grip styles. Planar portion 104 in FIG. 2 also varies in width (i.e., cross-sectional width WP in FIG. 6)

along longitudinal axis 136 of grip 100 to increase the extent or are of planar portion 104 to better accommodate different grip styles and hand dimensions or hand sizes.

Top portion 130 can include a rounded edge or bevel to transition exterior side surface 102 or portions thereof (i.e., planar portion 104 and/or arcuate portion 108) to top end 110. In other implementations, planar portion 104 may also extend through conical frustum portion 128 and/or through top portion 130. In some implementations, grip 100 may terminate at bottom end 112 without a narrowing of a circumference of grip 100, such as where grip 100 terminates at bottom end 112 with a cylindrical portion instead of conical frustum portion 128, for example.

As discussed below in more detail with reference to FIG. 3, arcuate portion 108 increases the amount of taper of grip 100 in a rearward direction as compared to conventional grips. Such narrowing of the rearward taper of arcuate portion 108 away from planar portion 104 ordinarily improves the ergonomics and feel of grip 100 for a variety of grip styles and hand dimensions or sizes. For all purposes herein, and unless otherwise stated, "rearward" is a relative term for a direction extending away from planar portion 104.

Figure 3:
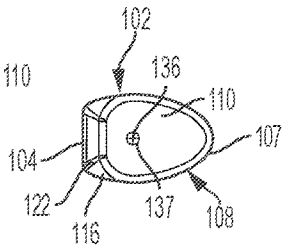
FIG. 3 is a top view of the grip of FIG. 2.

FIG. 3 is a top view of grip 100, which shows the narrowing or tapering of arcuate portion 108 and rear curved portion 107 in a rearward direction away from planar portion 104. FIG. 3 also shows exterior side surface 102 extending about virtual circumference 137 of virtual longitudinal axis 136. As discussed in more detail below with reference to FIG. 6, the dimensions of different cross-sections of grip 100 along longitudinal axis 136 can vary with respect to a cross-sectional maximum width, W, and a cross-sectional length, L. In addition, the depth, D, from planar portion 104 at which the cross-sectional maximum width occurs can also vary as measured perpendicularly from planar portion 104 for different grip cross-sections along longitudinal axis 136. A planar cross-sectional width, WP1, of planar portion 104 also varies for different grip cross-sections along longitudinal axis 136. Particular dimensions, ranges, and ratios for grip cross-sectional dimensions are disclosed below that provide an improved grip over conventional grips in terms of providing better control and feel for a wider range of grip styles and hand dimensions or hand sizes.

Figure 4:
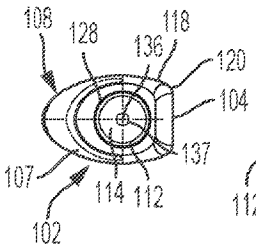
FIG. 4 is a bottom view of the grip of FIG. 2.

FIG. 4 is a bottom view of grip 100 showing longitudinal axis 136 defined by recess 114 in bottom end 112 as a center of recess 114. Recess 114 is configured to receive a golf shaft, such as golf shaft 10 in FIG. 1. As with the top view of FIG. 3, the bottom view of FIG. 4 shows the narrowing or tapering of arcuate portion 108 and rear curved portion 107 from the front side of grip 100 (i.e., the side of grip 100 with planar portion 104) toward the rear side of grip 100 (i.e., the side of grip 100 with rear curved portion 107).

Figure 5:
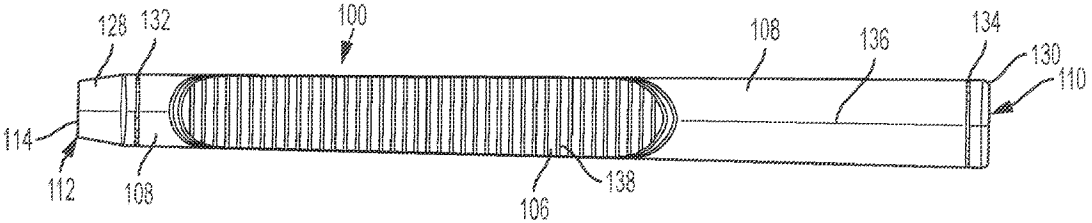
FIG. 5 is a rear view of the grip of FIG. 2.
Figure 7:
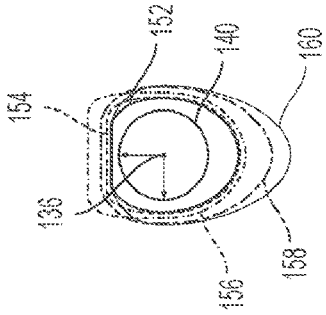
FIG. 7 is a view showing the overlap of the grip cross-sections from FIG. 6.
Figure 6:
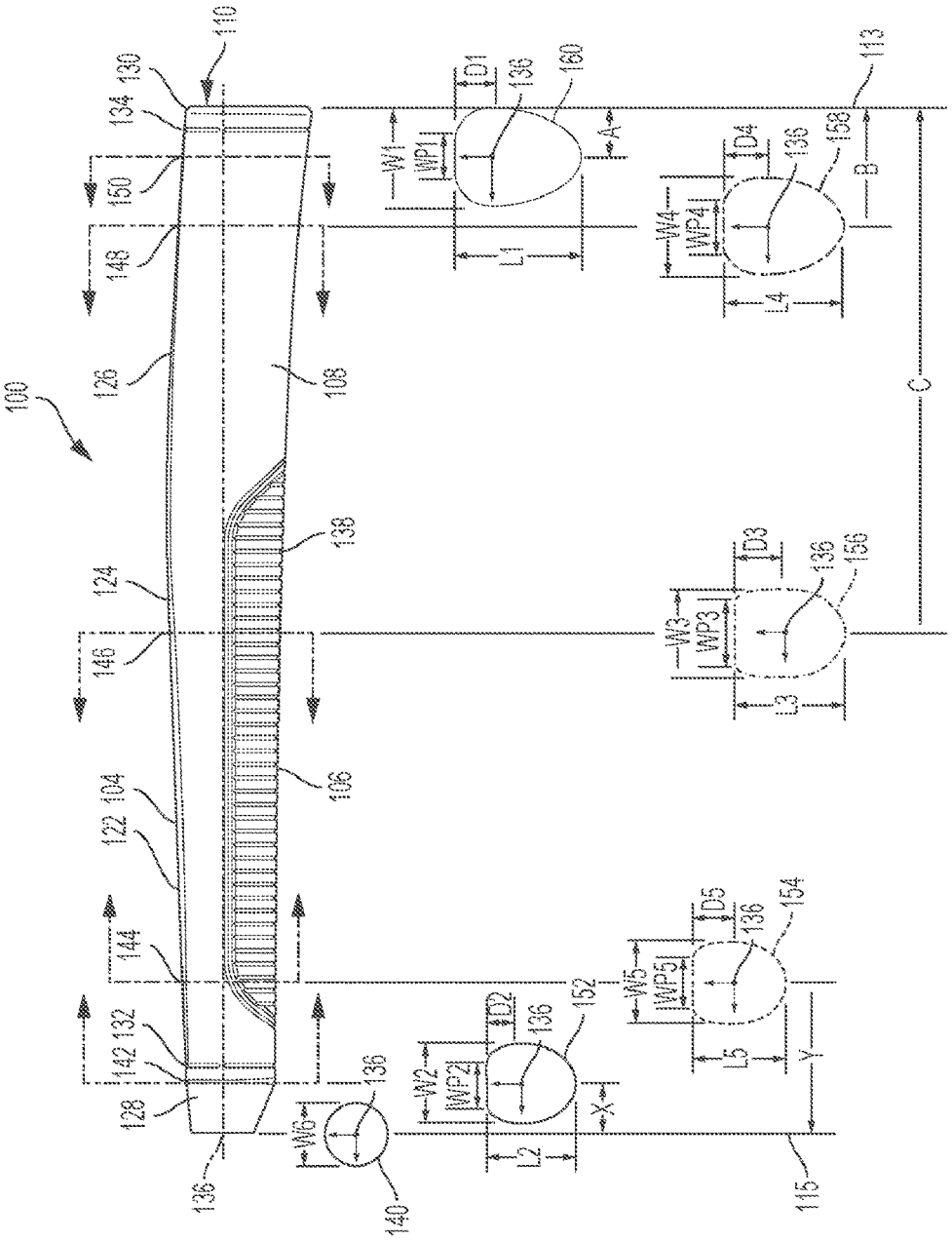
FIG. 6 is a side view of the grip of FIG. 2 including views of grip cross-sections at different axial locations along a virtual longitudinal axis of the grip.

As discussed in more detail below with reference to FIGS. 6 and 7, FIG. 4 shows an increase in the cross-sectional length, L, and in the cross-sectional width, W, when moving away from bottom end 112 toward top end 110 along longitudinal axis 136. The increase in cross-sectional width can also be seen in the rear view of grip 100 in FIG. 5.

As shown in FIG. 5, the width of grip 100 generally increases when moving along longitudinal axis 136 from bottom end 112 toward top end 110. FIG. 5 also shows more detail of grooved portion 106 of arcuate portion 108 that includes a plurality of grooves 138. In addition to channeling moisture or debris, and/or providing for airflow, grooved portion 106 can also provide a visual indication of a suggested location for placing the player's hands on grip 100 for most grip styles and hand dimensions. Other implementations may include a larger or smaller area for grooved portion 106, or may omit grooved portion 106 altogether.

FIG. 6 is a side view of grip 100 including views of grip cross-sections at different axial locations along longitudinal axis 136. The cross-sectional dimensions shown in FIG. 6 increase the extent of planar portion 104 and narrow the rearward taper of arcuate portion 108 to improve the ergonomics and feel of grip 100, as compared to conventional grips for putter-type golf clubs. As will be appreciated by those of ordinary skill in the art, recess 114 from FIG. 4 has been omitted from the grip cross-sections in FIG. 6 to avoid unnecessarily obscuring the dimensions of the grip cross-sections.

As shown in FIG. 6, first grip cross-section 160 is perpendicular to longitudinal axis 136 at axial location 150. Axial location 150 is at an axial distance of A from top end 110 along longitudinal axis 136, shown in FIG. 6 as a distance from line 113, which is aligned with top end 110. In the example of FIG. 6, A is no greater than 15 mm from top end 110, and preferably no less than 10 mm and no greater than 15 mm from top end 110. The distance A may also or alternatively be expressed as a percentage of the overall grip length, LG1, shown in FIG. 2. In the example of FIG. 6, A is no greater than 8% of LG1 from top end 110, more preferably no less than 4% and no greater than 8% of LG1 from top end 110, and most preferably 6% or approximately 6% (e.g., 5% to 7%) of LG1 from top end 110.

First grip cross-section 160 includes a first cross-sectional maximum width, W1, and a first cross-sectional length, L1. First grip cross-section 160 also includes a first planar portion cross-sectional width, WP1, within first cross-sectional maximum width W1. In the example of FIG. 6, WP1 is no less than 4 mm, preferably no less than 8 mm, and even more preferably no less than 9 mm and no greater than 11 mm. In comparison, conventional grips do not include a planar portion at a location corresponding to an axial distance of A in FIG. 6 from a top end of the grip (e.g., no greater than 15 mm from top end 110). Grip 100 in FIG. 6 therefore increases the extent or area of planar portion 104 farther toward top end 110 than conventional grips.

With respect to narrowing or lengthening the rearward taper of arcuate portion 108, first grip cross-section 160 has a first cross-sectional maximum width, W1, located at a depth D1 from planar portion 104, as measured perpendicularly in a rearward direction from planar portion 104. In the example of FIG. 6, a ratio of D1 to L1 is no greater than 0.40, preferably no less than 0.28 and no greater than 0.40, and even more preferably 0.34 or approximately 0.34 (e.g., 0.32 to 0.36). The ratio of D1 to L1 being no greater than 0.40 means that more of the overall first cross-sectional length, L1, is comprised of rear curved portion 107 to provide a greater rearward taper of exterior side surface 102.

In addition to the value of D1/L1 being no greater than 0.40, the narrowing of the taper of exterior side surface 102 in a rearward direction is further indicated by a ratio of the first cross-sectional maximum width, W1, to the first cross-sectional length, L1. However, grip 100 may balance providing a wider planar portion 104 (i.e., a greater value for WP1) against providing a narrower rearward taper by including a larger cross-sectional maximum width W1 to accommodate a wider planar portion. In the example of FIG. 6, a ratio of W1 to L1 is no greater than 0.85, and more preferably no less than 0.77 and no greater than 0.85, and even more preferably 0.81 or approximately 0.81 (e.g., 0.79 to 0.83).

Moving to the opposite end of grip 100, sixth grip cross-section 140 at bottom end 112 is generally circular with a width or diameter of W6. The cross-sections of grip 100 remain generally circular along longitudinal axis 136 through conical frustum portion 128 until reaching second grip cross-section 152 at axial location 142.

As shown in FIG. 6, second grip cross-section 152 includes a second cross-sectional maximum width, W2, and a second cross-sectional length, L2. Axial location 142 is at an axial distance of X from bottom end 112 along longitudinal axis 136, shown in FIG. 6 as a distance from line 115, which is aligned with bottom end 112. In the example of FIG. 6, X is no greater than 15 mm from bottom end 112, and preferably no less than 10 mm and no greater than 15 mm from bottom end 112. The distance X may also or alternatively be expressed as a percentage of the overall grip length, LG1, shown in FIG. 2. In the example of FIG. 6, axial location 142 is no less than 90% of LG1 from top end 110, more preferably no less than 90% and no greater than 96% of LG1 from top end 110, and most preferably 93% or approximately 93% (e.g., 92% to 94%) of LG1 as measured from top end 110.

Second grip cross-section 152 also includes a second planar portion cross-sectional width, WP2, within second cross-sectional maximum width W2. In the example of FIG. 6, WP2 is no less than 4 mm, preferably no less than 8 mm, and even more preferably no less than 9 mm and no greater than 11 mm. In comparison, conventional grips do not have a planar portion at a location corresponding to an axial distance of X in FIG. 6 from a bottom end of the grip (e.g., no greater than 15 mm from bottom end 112). Grip 100 in FIG. 6 therefore increases the extent or area of planar portion 104 farther toward bottom end 112 than conventional grips.

With respect to narrowing or lengthening the rearward taper of arcuate portion 108, second grip cross-section 152 has a second cross-sectional maximum width, W2, located at a depth D2 from planar portion 104, as measured perpendicularly from planar portion 104 in a rearward direction. In the example of FIG. 6, a ratio of D2 to L2 is no greater than 0.45, preferably no less than 0.39 and no greater than 0.45, and even more preferably 0.42 or approximately 0.42 (e.g., 0.40 to 0.44). The ratio of D1 to L1 being no greater than 0.45 means that more of the overall second cross-sectional length, L2, is comprised of rear curved portion 107 to provide a greater rearward taper of exterior side surface 102.

In addition to the value of D2/L2 being no greater than 0.45, the narrowing of the taper of exterior side surface 102 in a rearward direction is further indicated by a ratio of the second cross-sectional maximum width, W2, to the second cross-sectional length, L2. However, grip 100 may balance providing a wider planar portion 104, WP, against providing a narrower rearward taper by including a larger cross-sectional maximum width W2 to accommodate a wider planar portion (i.e., a greater value for WP2). In the example of FIG. 6, a ratio of W2 to L2 is no greater than 0.97, and more preferably no less than 0.91 and no greater than 0.97, and even more preferably 0.94 or approximately 0.94 (e.g., 0.92 to 0.96). In comparison, a conventional grip usually has almost the same values for its cross-sectional maximum width, W, and cross-sectional length, L, at a similar axial location, such that conventional ratios for W/L are 0.99 or nearly 1.

As shown in FIG. 6, third grip cross-section 156 is at axial location 146. Axial location 146 is at an axial distance of C from top end 110 along longitudinal axis 136, shown in FIG. 6 as a distance from line 113, which is aligned with top end 110. In the example of FIG. 6, C is no less than 120 mm from top end 110, and no greater than 140 mm from top end 110. The distance C may also or alternatively be expressed as a percentage of the overall grip length, LG1, shown in FIG. 2. In the example of FIG. 6, axial location 146 is no less than 45% of LG1 from top end 110, and no greater than 50% from top end 110, more preferably 50% or approximately 50% (e.g., 49% to 51%) of LG1 from top end 110.

Third grip cross-section 156 includes a third cross-sectional maximum width, W3, and a third cross-sectional length, L3. Third grip cross-section 156 also includes a third planar portion cross-sectional width, WP3, within third cross-sectional maximum width W3. In the example of FIG. 6, WP3 is no less than 10 mm, preferably no less than 15 mm, and even more preferably no less than 16.5 mm and no greater than 17 mm. In comparison, most conventional grips generally have a narrower planar portion at a location corresponding to an axial distance of C in FIG. 6 from a top portion of the grip (e.g., no less than 120 mm from top end 110 and no greater than 140 mm from top end 110). Grip 100 in FIG. 6 therefore increases the extent or area of planar portion 104 at a middle portion of grip 100, as compared to conventional grips.

With respect to narrowing or lengthening the rearward taper of arcuate portion 108, third grip cross-section 156 has a third cross-sectional length, L3, that provides a greater rearward taper than conventional grips at a similar axial location, despite grip 100 also having a generally wider planar portion 104 (i.e., a larger value of WP3) at a similar axial location. In this regard, for grip 100 in the example of FIG. 6, a ratio of the third cross-sectional maximum width, W3, to the third cross-sectional length, L3, is no greater than 0.90, preferably no greater than 0.85, more preferably no less than 0.77 and no greater than 0.85, and even more preferably 0.81 or approximately 0.81 (e.g., between 0.80 and 0.82). In comparison, a planar portion of a conventional grip usually has almost the same values for its cross-sectional maximum width, W, and cross-sectional length, L, at a similar axial location, such that conventional ratios for W/L are 0.99 or nearly 1. The third cross-sectional length, L3, in FIG. 6 is no less than 26 mm, and preferably no less than 26 mm and no greater than 30 mm to allow room for a greater rearward taper. In addition, the third depth D3 measured perpendicularly from planar portion 104 to the third cross-sectional maximal width, W3, is no greater than 0.65, and preferably no greater than 0.60.

Intermediate grip cross-section 154 located at axial location 144 illustrates a transition between second grip cross-section 152 and third grip cross-section 156. Axial location 144 is at an axial distance of Y from bottom end 112 along longitudinal axis 136, shown in FIG. 6 as a distance from line 115. The width of planar portion 104, WP, increases from second grip cross-section 152 toward third grip cross-section 156, such that WP5 is greater than WP2, and less than WP3 in a middle portion of grip 100. In addition, the cross-sectional length, L, increases from second grip cross-section 152 toward third grip cross-section 156 to continue to provide a relatively narrow rearward taper of grip 100 as the cross-sectional maximum width, W, may increase to allow for a wider planar portion 104. In the example of FIG. 6, L5 is greater than L2, and less than L3, as the cross-sectional maximum widths, W, increase. The depth of the cross-sectional maximum width, D, may also increase or may remain the approximately same when moving from second grip cross-section 152 toward third grip cross-section 156, while maintaining a relatively narrow rearward taper of grip 100. For example, D5 may be greater than D2, but less than D3. In the example of FIG. 6, the rearward taper becomes narrower when moving from second grip cross-section 152 near bottom end 112 toward first grip cross-section 160 near top end 110.

Intermediate grip cross-section 158 located at axial location 148 illustrates a transition between first grip cross-section 160 and third grip cross-section 156 at a middle portion of grip 100. Axial location 148 is at an axial distance of B from top end 110 along longitudinal axis 136, shown in FIG. 6 as a distance from line 113. The width of planar portion 104, WP, increases from first grip cross-section 160 toward third grip cross-section 156, such that WP4 is greater than WP1, and less than WP3. As noted above, the rearward taper of grip 100 becomes narrower when moving toward top end 110. The cross-sectional length, L, may therefore increase as the depth of the cross-sectional maximum width, D, may remain approximately the same or decrease. For example, L4 may be greater than L3 and less than L1, but D4 may be less than D3 and greater than D1 to increase the narrowness of the rearward taper when moving along longitudinal axis 136 toward top end 110.

FIG. 7 is a view showing the overlap of the grip cross-sections from FIG. 6. As shown in FIG. 7, the narrowness of the rearward taper increases when moving from second grip cross-section 152 near bottom end 112 to first grip cross-section 160 near top end 110. In addition, the cross-sectional maximum width, W, increases from second grip cross-section 152 near bottom end 112, and then generally remains approximately the same or increases slightly past a middle portion of grip 100 at third grip cross-section 156 to first grip cross-section 160 near top end 110. The width of planar portion 104, WP, increases from second grip cross-section 152 near bottom end 112 to third grip cross section 156 near a middle portion of grip 100, and then decreases going from third grip cross-section 156 to first grip cross-section 160 near top end 110.

As discussed above, by increasing the extent or area of planar portion 104 along a greater axial length of grip 100, it is ordinarily possible to improve the control and feel of a golf club for a wider variety of grip styles and hand dimensions. In addition, the narrowing of a rearward taper of exterior side surface 102 can also provide a better fit for a wider variety of grip styles and hand dimensions.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. For example, some alternative embodiments may include grips with increased extents of planar portions or narrower rearward tapers for use with different types of golf clubs other than a putter-type golf club. Accordingly, the described embodiments are to be considered in all respects only as illustrative and not restrictive. All changes which come within the meaning and range of equivalency of the claims are to be embraced within their scope.

What is claimed is:

1. A grip for a putter-type golf club, the grip comprising:

a bottom end having a recess therein configured to receive a golf shaft, the recess defining a virtual longitudinal axis of the grip;

a top end opposite the bottom end; and an exterior side surface extending about the entire circumference of the longitudinal axis, the exterior side surface consisting of a generally planar portion and a generally arcuate portion adjoining the planar portion on each longitudinal side such that, in a first grip cross-section perpendicular to the longitudinal axis and at an axial location of no greater than 15 mm from the top end of the grip:

(a) the grip comprises a first cross-sectional maximum width, W1, and a first cross-sectional length, L1;

(b) the planar portion comprises a first planar portion cross-sectional width, WP1, of no less than 4 mm; and (c) the first maximum cross-sectional width W1 is located at a depth D1 from, and measured perpendicularly to, the planar portion such that D1/L1 is no greater than 0.40; and wherein, in a second grip cross-section perpendicular to the longitudinal axis and at an axial location of no greater than 15 mm from the bottom end of the grip:

(a) the grip comprises a second cross-sectional maximum width, W2, and a second cross-sectional length, L2;

(b) the planar portion comprises a second planar portion cross-sectional width, WP2, of no less than 4 mm;

(c) the second maximum cross-sectional width W2 is located at a depth D2 from, and measured perpendicularly to, the planar portion such that D2/L2 is no greater than 0.45; and (d) W1/L1 is less than W2/L2.

2. The grip of claim 1, wherein the grip comprises a material selected from the group consisting of: synthetic rubber, natural rubber, and an elastomer.

3. The grip of claim 1, wherein WP1 is no less than 8 mm.

4. The grip of claim 1, wherein W1/L1 is no greater than 0.85.

5. The grip of claim 1, wherein the planar portion comprises a length, LP1, measured in the direction of the longitudinal axis of no less than 220 mm.

6. The grip of claim 5, wherein LP1 is no less than 240 mm.

7. The grip of claim 5, further comprising an overall grip length, LG1, such that LP1/LG1 is no less than 0.90.

8. The grip of claim 1, wherein WP2 is no less than 8 mm.

9. A grip for a putter-type golf club, the grip comprising:

a bottom end having a recess therein configured to receive a golf shaft, the recess defining a virtual longitudinal axis of the grip;

a top end opposite the bottom end; and an exterior side surface extending about the circumference of the longitudinal axis, the exterior side surface defining a generally planar portion and a generally arcuate portion adjoining the planar portion such that, in a first grip cross-section perpendicular to the longitudinal axis and at an axial location of between 120 mm and 140 mm measured from the top end of the grip, the grip comprises a first cross-sectional maximum width, W3, and a first cross-sectional length, L3, such that W3/L3 is no greater than 0.90; and wherein, in a second grip cross-section perpendicular to the longitudinal axis and at an axial location of no greater than 15 mm from the bottom end of the grip:

(a) the grip comprises a second cross-sectional maximum width, W2, and a second cross-sectional length, L2;

(b) the planar portion comprises a second planar portion cross-sectional width, WP2, of no less than 4 mm;

(c) the second maximum cross-sectional width W2 is located at a depth D2 from, and measured perpendicularly to, the planar portion such that D2/L2 is no greater than 0.45; and (d) W3/L3 is less than W2/L2.

10. The grip of claim 9, wherein W3/L3 is no greater than 0.85.

11. The grip of claim 9, wherein, in the first grip cross-section, the first maximum cross-sectional width W3 is located at a depth D3 from, and measured perpendicularly to, the planar portion such that D3/L3 is no greater than 0.65.

12. The grip of claim 11, wherein D3/L3 is no greater than 0.60.

13. The grip of claim 9, wherein, in the first grip cross-section, the planar portion comprises a planar portion cross-sectional width, WP3, of no less than 10 mm.

14. The grip of claim 13, wherein WP3 is no less than 15 mm.

15. The grip of claim 9, wherein the grip comprises a material selected from the group consisting of: synthetic rubber, natural rubber, and an elastomer.

16. The grip of claim 9, wherein the planar section comprises a length, LP1, measured in the direction of the longitudinal axis of no less than 220 mm.

17. The grip of claim 16, wherein LP1 is no less than 240 mm.

18. The grip of claim 16, further comprising an overall grip length, LG1, no less than 250 mm, wherein LP1/LG1 is no less than 0.90.

19. The grip of claim 9, wherein L3 is no less than 26 mm.

* * * * *